US007198526B1

(12) United States Patent
MacNeil et al.

(10) Patent No.: US 7,198,526 B1
(45) Date of Patent: Apr. 3, 2007

(54) LOW-PROFILE FLAG ELECTRICAL TERMINAL CONNECTOR ASSEMBLY

(75) Inventors: John J. MacNeil, Valrico, FL (US); Dennis Herdegen, Sarasota, FL (US); Ralph E. Jacques, Sarasota, FL (US); Christopher S. O'Reilly, Westville, MA (US); Brian J. Stumm, Saunderstown, RI (US)

(73) Assignee: ETCO, Inc., Warwick, RI (US)

( * ) Notice: Subject to any disclaimer, the term of this patent is extended or adjusted under 35 U.S.C. 154(b) by 0 days.

(21) Appl. No.: 11/284,058

(22) Filed: Nov. 21, 2005

(51) Int. Cl.
*H01R 9/24* (2006.01)

(52) U.S. Cl. ..... 439/881

(58) Field of Classification Search ..... 439/881, 439/887, 850, 937, 955, 954, 595, 749, 746, 439/748

See application file for complete search history.

(56) References Cited

U.S. PATENT DOCUMENTS 3,123,431 A * 3/1964 Keller ..... 439/881
3,546,664 A * 12/1970 De Bolt et al. ..... 439/866
3,555,493 A * 1/1971 Baumanis ..... 439/636
3,787,801 A * 1/1974 Teagno et al. ..... 439/855
6,368,165 B2 * 4/2002 Kubo ..... 439/752
6,652,293 B2 * 11/2003 Fuchs et al. ..... 439/76.1
6,837,745 B2 * 1/2005 Takada et al. ..... 439/595
7,052,301 B2 * 5/2006 Garcia et al. ..... 439/336

* cited by examiner

*Primary Examiner*—Phuong Dinh
(74) *Attorney, Agent, or Firm*—Altman & Martin

(57) ABSTRACT

A low-profile, flag quick-connect terminal connector assembly where the connector, when assembled, is completely insulated. The electrically-conductive, metallic connector has a transition with an industry-standard crimp at one end and a contact at the other. The contact floor and pair of opposed retention rails form a tab slot that is perpendicular to, centered on, and offset from the transition. The rigid plastic insulator covers the connector so that no part of the connector is outside of the insulator. The insulator provides a pre-lock mechanism where the contact is inside and the crimp is outside, and a locking mechanism where the connector is entirely within the insulator.

8 Claims, 5 Drawing Sheets

LOW-PROFILE FLAG ELECTRICAL TERMINAL CONNECTOR ASSEMBLY

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical connectors, more particularly, to flag, quick-disconnect, crimp terminals.

2. Description of the Related Art

Quick-connect terminal connectors are female terminals that mate with male tab terminals, tab adapters, and tab terminal blocks. They are used where quick attachment and removability are desired. Flag connectors have the quick attachment at a right angle to the electrical wire to which the connector is attached. They are available as fully insulated, non-insulated, or partially insulated. They are available with open or closed barrel crimps (indentor, confined, or a combination of the two), B (single) crimps or F (double) crimps.

One reason for the existence of flag terminals is for space saving because a right angle terminal can generally fit into smaller spaces than straight terminals. The quick connect portion of flag terminals of the prior art extend at a right angle away from the axis of the wire in an L shape. Consequently, when connected to a vertical tab terminal, these flag terminals extend higher than the tab terminal, requiring a relatively large amount of clearance above the tab terminal.

BRIEF SUMMARY OF THE INVENTION

An object of the present invention is to provide a flag terminal that has a lower profile and that fits into smaller spaces than flag terminals of the prior art.

Another object is to provide a low-profile flag terminal that is fully insulated.

Yet another object is to provide a low-profile flag terminal with an F crimp.

The present invention is a flag quick-connect terminal connector assembly that includes a connector and an insulator. When the connector is installed within the insulator, the terminal connector assembly provided a completely insulated, low-profile flag quick-connect.

The electrically-conductive, metallic connector has a transition with a longitudinal axis with a crimp at one end of the axis and a contact at the other. The crimp is of a style commonly used in the industry.

The contact has a floor that is generally parallel to the transition and a pair of opposed retention rails that are typical in the art. The ends of the retention rails are above the floor, forming a slot into which a male tab is inserted. The slot is perpendicular to, centered on, and offset from the transition axis. The contact is formed by bending the contact that extends from the side of the transition about 180° to center the contact on the transition, thereby providing the low-profile characteristic when compared to the flag connectors of the prior art.

The insulator, composed of a rigid, electrically insulating plastic, covers the connector so that no part of the connector is outside of the insulator. The insulator provides mechanisms for retaining the connector in a pre-lock position where the contact is inside and the crimp is outside, and for retaining the connector in a locked position where the connector is entirely within the insulator. The present specification describes two embodiments of the pre-lock mechanism and three embodiments of the locking mechanism. When the connector is locked within the insulator, the connector slot is aligned with a side opening in the insulator wall through which the male tab is inserted.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
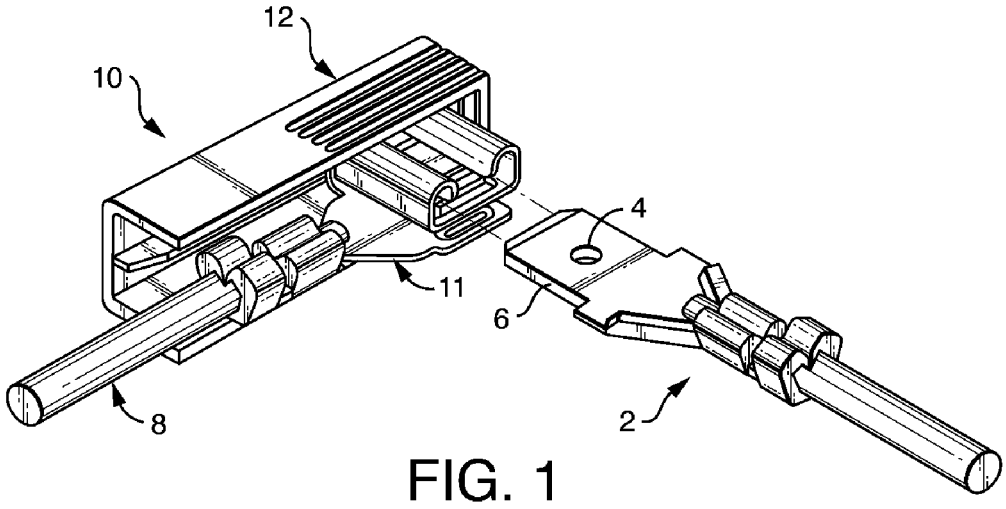
FIG. 1 is a top perspective, cutaway view of one configuration of the connector/insulator assembly of the present invention shown with a wire and mating male tab connector.
Figure 2:
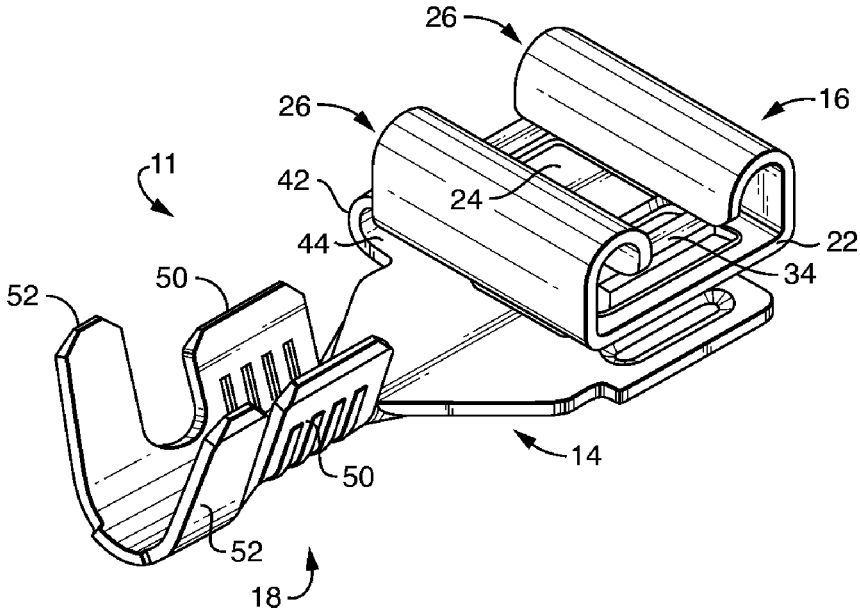
FIG. 2 is a top perspective view of the connector of FIG. 1.
Figure 3:
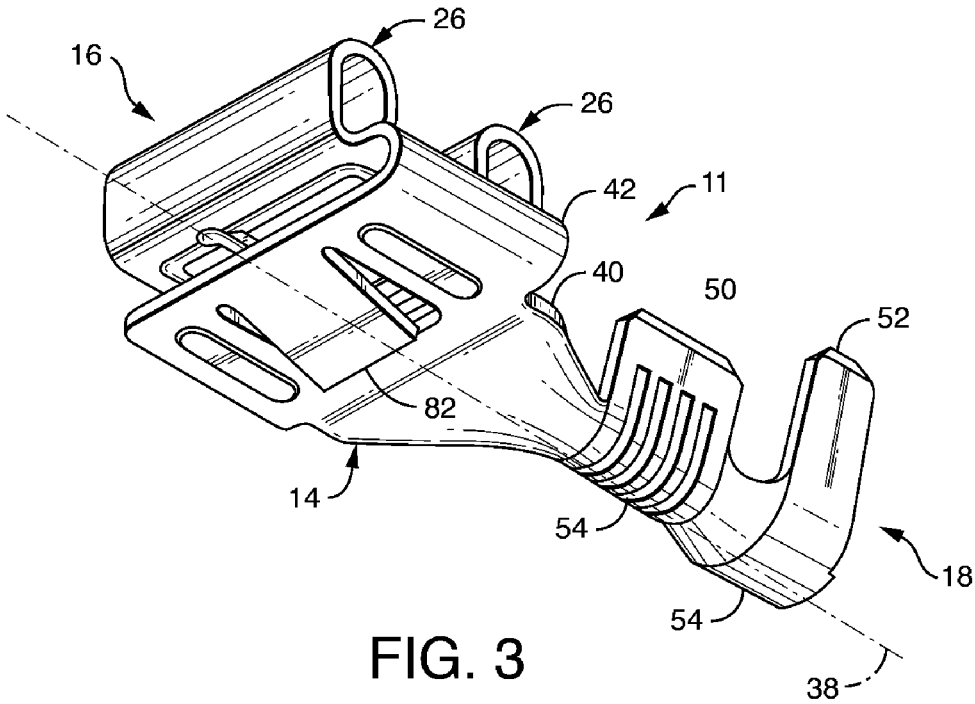
FIG. 3 is a bottom perspective view of the connector of FIG. 1.
Figure 4:
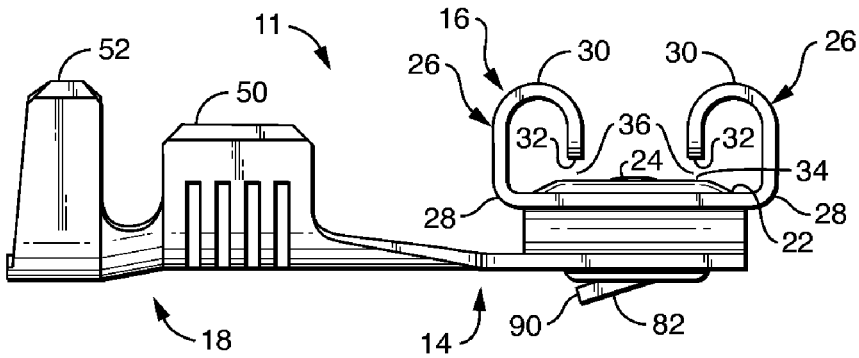
FIG. 4 is a side view of the connector of FIG. 1.

The present invention is a flag quick-connect terminal connector assembly. FIG. 1 is a cutaway showing the components of the assembly 10 of the present invention as assembled with a wire 8 and with a mating male tab connector 2, although the wire 8 and tab connector 2 are not elements of the present invention. The assembly 10 includes a connector 11 and an insulator 12. As shown in FIGS. 2–4, the connector 11 has a transition 14 with a longitudinal axis 38. At one end of the transition, along the axis 38, is a crimp 18. At the other end of the transition 14 is a contact 16. The connector 11 is composed of a electrically conductive metallic material, such as aluminum and aluminum alloys and copper and copper alloys, the most common being brass.

The illustrated crimp 18 is of a style commonly used in the industry. The base 54 of the crimp 18 extends along the axis 38 from the transition. Two pairs of ears 50, 52 extend generally radially away from the crimp base 54, bending away from the base 54 to form a U. The inner pair of ears 50 crimp around the bare conductor of a wire 8 to provide a secure electrical connection in a manner well known in the art. The outer pair of ears 52 crimp around the insulation of the wire 8 to provide a secure mechanical connection, a strain relief, in a manner well known in the art. The present invention contemplates that any type of crimp connection that is adequate for the particular application of the connector 11 may be employed.

The contact 16 has a floor 22 that is generally parallel to the transition 14. The floor 22 has a raised land 34 and dimple 24 that are created by embossing the floor 22. A pair of opposed retention rails 26 are bent upwardly from the contact floor 22 approximately 90°, as at 28, and then curled approximately 180° downwardly and toward each other, as at 30. The ends 32 of the retention rails 26 are above the land 34, forming a slot 36 into which the blade 6 of a male tab connector 2 is inserted. The contact floor 22 forms one side of the slot 36 and the retention rail ends 32 form the other side of the slot 36. A combination of the spring action of the retention rails 26 and the dimple 24 fitting into a corresponding dimple or hole 4 in the male tab connector blade 6 creates a secure electrical connection with the male tab connector 2.

The slot 36 is generally perpendicular to, centered on, and offset from the transition axis 38. Prior to formation, the contact 16 extends from the side 40 of the transition 14. During formation, the transition 14 is bent about 180°, as at 42, to center the contact 16 on the transition 14. Centering the contact 16 on the transition 14 provides the low-profile characteristic of the connector 11 when compared to the flag connectors of the prior art. The figures show a floor 22 spaced from the transition 14 by a gap 44. Alternatively, there is no gap 44, that is, the contact floor 22 abuts the transition 14.

Figure 5:
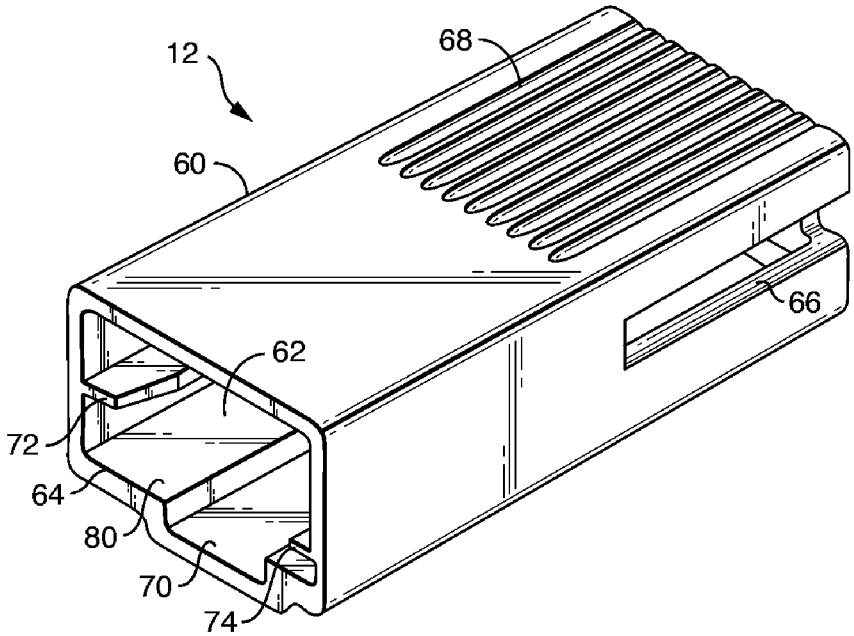
FIG. 5 is a perspective view of one embodiment of the insulator.
Figure 6:
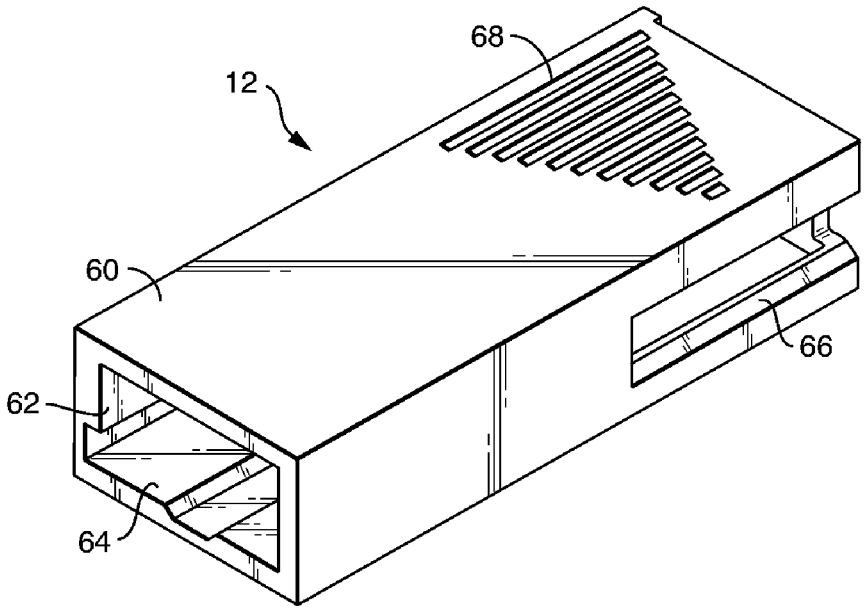
FIG. 6 is a perspective view of another embodiment of the insulator.

The insulator 12, shown in two embodiments in FIGS. 5 and 6, covers the connector 11 so that no part of the connector 11 is external to the insulator 12. The insulator 12 is a housing 60 that has a connector opening 64 in one end for receiving the connector 11 within a generally rectangular chamber 62 and a mate opening 66 in one side for receiving the blade 6 of a mating male tab connector 2. Optionally, the insulator 12 includes ribs 68 to provide a more secure finger grip for installation and removal. The insulator 12 is composed of a rigid, electrically insulating plastic, such as nylon. Optionally, the insulator 12 is composed of a flame-retardant nylon.

The insulator 12 provides a mechanism for retaining the connector 11 inside the insulator 12 in a pre-lock position where the contact 16 is inside the insulator chamber 62 and the crimp 18 is outside the chamber 62. The purpose of the pre-lock position is to partially assemble the connector/insulator assemblage for shipment to the manufacturing facility where the connector 11 will be crimped onto a wire 8. The present specification describes two embodiments of the pre-lock mechanism. These embodiments are merely examples and the present invention contemplates that any other mechanism that provides the function of pre-locking the connector 11 within the insulator 12 appropriately can be employed.

Figure 7:
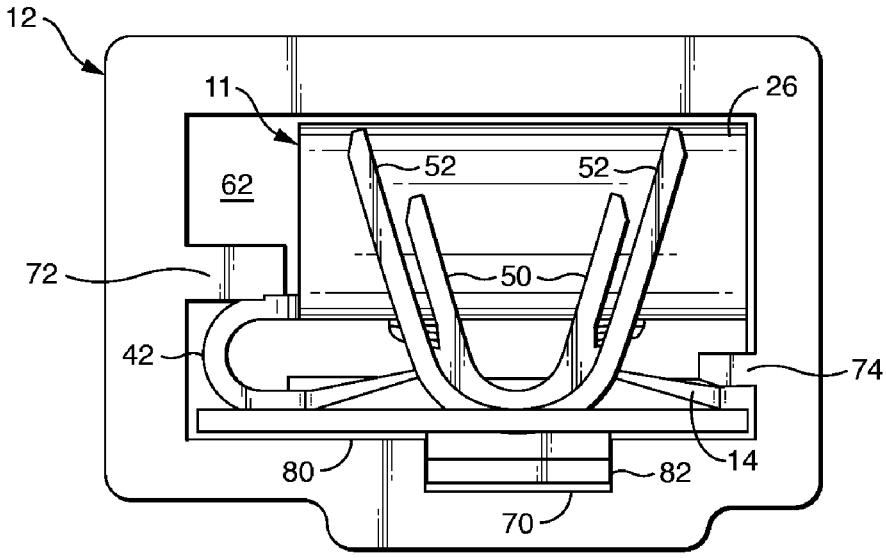
FIG. 7 is an end view of one embodiment of the pre-lock mechanism.

In one embodiment of the pre-lock mechanism, shown in FIGS. 5 and 7, there is a groove 70 in the floor 80 of the chamber 62 and two rails 72, 74 extending from the walls of the chamber 62. A finger 82 protruding downwardly from the underside of the transition 14 at an acute angle, shown in FIGS. 3 and 4, slides within the groove 70 to keep the connector 11 centered in the chamber 62. The bend 42 between the transition 14 and the contact 16 wedges under one rail 72 and the transition 14 wedges under the other rail 74. Friction of the connector 11 between the rails 72, 74 and the chamber floor 80 maintains the connector 11 in the pre-lock position.

Figure 8:
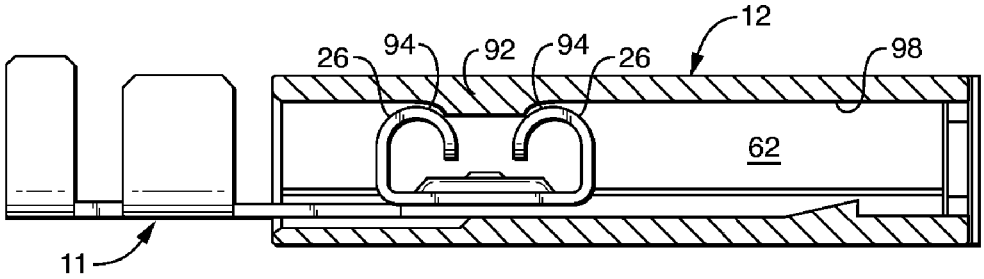
FIG. 8 is a partial cross-sectional side view of a second embodiment of the pre-lock mechanism.

In a second embodiment, shown in FIGS. 6 and 8, the ceiling 98 of the interior chamber 62 has a downwardly extending pre-lock protrusion 92. The protrusion 92 is sized to fit between the two retention rails 26 of the connector 11. The leading edge 94 and trailing edge 96 of the protrusion 92 are rounded so that the retention rails 26 can pass the protrusion 92 with the use of moderate force.

After the connector 11 is crimped onto the wire 8, the connector 11 is pushed to its permanent position in the insulator 12 and held in a locked position by a locking mechanism where the contact slot 36 is aligned with the mate opening 66. The present specification describes three embodiments of the locking mechanism. These embodiments are merely examples and the present invention contemplates that any other mechanism that provides the function of locking the connector 11 within the insulator 12 appropriately can be employed.

Figure 9:
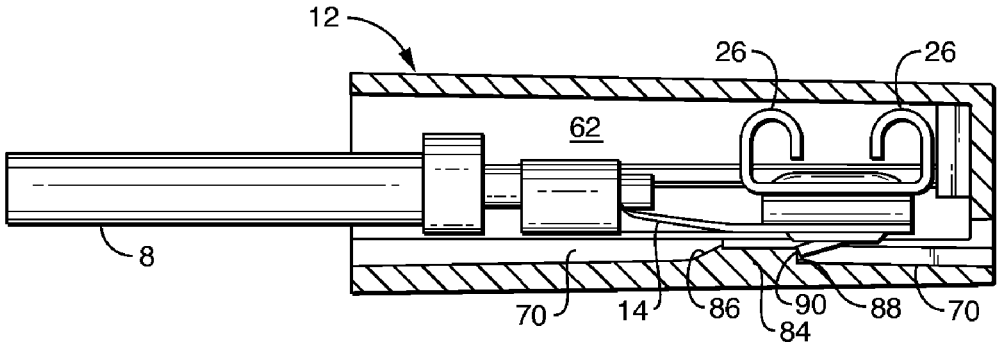
FIG. 9 is a partial side cross-sectional view of one embodiment of the locking mechanism.

In the first embodiment, shown in FIG. 9, the protruding finger 82 extends rearwardly, that is, toward the crimp 18. As the connector 11 is pushed into the insulator 12, the finger 82 passes over a protrusion 84 extending from the chamber groove 70 with a ramped leading face 86. The leading face 86 pushes the finger 82, which acts like a leaf spring, from its quiescent (unsprung) state to a sprung state up toward the transition 14. As the finger 82 passes beyond the protrusion 84, the finger 82 springs back into the groove 70. The free edge 90 of the finger 82 abuts the trailing perpendicular face 88 of the protrusion 84, preventing removal of the connector 11 from the insulator 12. Alternatively, the chamber 62 does not have a groove 70 and the protrusion extends from the chamber floor 80.

Figure 10:
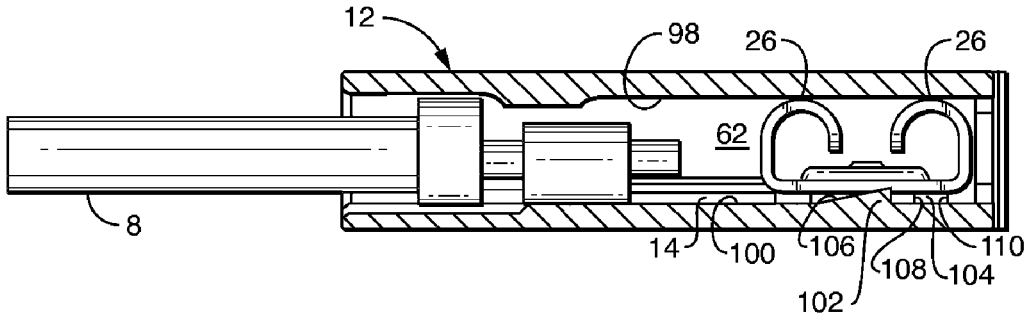
FIG. 10 is a partial side cross-sectional view of a second embodiment of the locking mechanism.

In the second embodiment, shown in FIG. 10, the floor 100 of the chamber 62 has an upward permanent protrusion 102 that is sized to fit into a depression 104 in the transition 14. The leading side of the protrusion 102 is a ramp 106 from the chamber floor 100 and the trailing side is a vertical face 108. As the connector 11 is pushed into the insulator 12, the connector 11 passes over the protrusion 102. The protrusion ramp 106 forces the retention rails 26 against the chamber ceiling 98, which then exert a downward pressure on the connector 11. When the trailing face 108 of the protrusion 102 passes into the connector depression 104, the force from the retention rails 26 causes the protrusion 102 to snap into the depression 104. The vertical face 108 abuts the vertical leading wall 110 of the depression 104, preventing removal of the connector 11 from the insulator 12.

Figure 11:
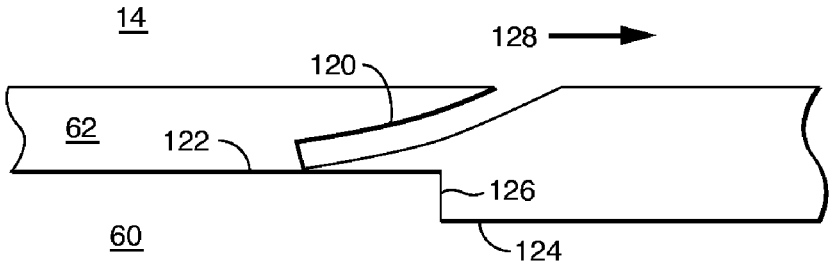
FIG. 11 is a detailed top cross-sectional view of a third embodiment of the locking mechanism.

In the third embodiment, shown in FIG. 11, a small finger 120 extends rearwardly from the side of the connector 11. As the connector 11 is pushed into the chamber 62, shown as 128, the finger 120 is pushed pressed against the connector 11 by the chamber wall 122. Eventually, the finger 120 passes a depression 124 in the chamber wall 122, whereby the finger 120 springs into the depression 124. The depression 124 has a flat wall 126 that the finger 120 catches on if an attempt is made to pull the connector 11 from the insulator 12.

When the connector 11 is locked within the insulator 12, the connector slot 36 is aligned with the side opening 66 in the insulator wall and the crimp 18 is fully within the insulator 12.

Thus it has been shown and described a low profile electrical terminal connector assembly that satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

We claim:

1. An electrical terminal connector assembly for mating with a male tab connector having a blade, said assembly comprising:

(a) a connector composed of an electrically conductive material, said connector having a transition with a longitudinal axis, a crimp extending from an end of said transition along said longitudinal axis, and a contact extending from an end of said transition opposite said crimp, said contact having a slot adapted to receive said male tab connector blade, said slot being generally perpendicular to said longitudinal axis;

(b) an insulator composed of an electrically insulating material, said insulator having a connector opening, a generally rectangular chamber extending into said insulator from said connector opening, and a mate opening;

(c) said assembly movable from a pre-lock position, wherein said crimp is external to said chamber and said contact is within said chamber, to a locked position, wherein said connector is completely within said chamber and said slot is aligned with said mate opening;

(d) a pre-lock mechanism for maintaining said pre-lock position; and (e) a locking mechanism for maintaining said locking position.

2. The electrical terminal connector assembly of claim 1 wherein said contact includes a floor generally parallel to said transition and coupled to said transition by an approximately 180° bend.

3. The electrical terminal connector assembly of claim 2 wherein said slot is defined by said floor and a pair of opposed retention rails, said rails extending approximately 90° from said floor and curling approximately 180° toward said floor.

4. The electrical terminal connector assembly of claim 2 wherein said chamber has a floor and side walls, said pre-lock mechanism includes a first rail extending from a first of said chamber walls adapted to allow said bend to slide between said first rail and said chamber floor with friction, and a second rail extending from a second of said chamber walls adapted to allow said transition to slide between said second rail and said chamber floor with friction, said friction retaining said connector in said pre-lock position.

5. The electrical terminal connector assembly of claim 1 wherein said locking mechanism comprises:

(a) a finger extending toward said crimp at an acute angle from said transition, said finger having a free edge;

(b) a protrusion extending into said chamber from a chamber surface, said protrusion having a ramped leading face and a perpendicular trailing face;

(c) whereby, as said connector is moving from said pre-lock position to said locked position, said leading face pushes said finger from a quiescent state to a sprung state and, as said finger passes said protrusion, said finger returns to said quiescent state, and whereby said finger free edge abuts said perpendicular face to retain said connector in said locked position when attempted to move said connector from said locked position to said pre-lock position.

6. The electrical terminal connector assembly of claim 1 wherein said crimp has a base that extends along said axis and at least one pair of ears extending generally radially away from said base.

7. The electrical terminal connector assembly of claim 1 wherein said insulator is composed substantially of nylon.

8. The electrical terminal connector assembly of claim 1 wherein said connector is composed of a metallic material.

* * * * *